US005097246A

United States Patent [19]

Cook et al.

[11] Patent Number: 5,097,246

[45] Date of Patent: Mar. 17, 1992

[54] LOW AMPERAGE MICROFUSE

[75] Inventors: James W. Cook, Ellisville; Terence J. Evans, Ballwin, both of Mo.

[73] Assignee: Cooper Industries, Inc., Houston, Tex.

[21] Appl. No.: 510,361

[22] Filed: Apr. 16, 1990

[51] Int. Cl.[5] ..... H01H 85/04; H01H 85/43

[52] U.S. Cl. ..... 337/297; 337/231

[58] Field of Search ..... 337/296, 295, 297, 290, 337/163, 166, 231, 232

[56] References Cited

U.S. PATENT DOCUMENTS 4,626,818 12/1986 Hilgers ..... 337/297

4,771,260 9/1988 Gurevich ..... 337/231

4,873,506 10/1989 Gurevich ..... 337/297

FOREIGN PATENT DOCUMENTS 2830963 1/1980 Fed. Rep. of Germany .

3033323 3/1981 Fed. Rep. of Germany .

1213736 11/1970 United Kingdom .

*Primary Examiner*—Harold Broome

[57] ABSTRACT

A subminiature fuse includes a ceramic substrate with a glass coating disposed over a portion thereof. A fusing link is disposed on the glass coating, and weld pads for receiving fuse leads are disposed on opposite sides of the glass coating. The substrate, with leads attached, is encapsulated in plastic.

16 Claims, 2 Drawing Sheets

LOW AMPERAGE MICROFUSE

BACKGROUND OF THE PRESENT INVENTION

The present invention relates to the field of fuses, more particularly to microfuses.

Microfuses are physically small fuses typically used to protect electronic components used in transistorized circuitry, such as televisions, radios, computers, and other devices requiring physically small circuit interruption devices. A typical microfuse may be about ½ of an inch long and about 1/10 of an inch wide.

One prior art microfuse that is suitable for high speed automated assembly employs a ceramic substrate having metallized weld pads on the opposed ends thereof, having wire leads attached thereto, and a fusing link in the form of a wire ultrasonically bonded to the metallized weld pads. The substrate, with pads and wire thereon, may be coated in an arc quenching media, and then coated in a protective coating such as plastic.

The microfuse employing an ultrasonically bonded fusing wire has a limited range of ratings. The minimum diameter of the automatically bonded wire is too large to allow the fuse designer to achieve a fractional amperage fuse. Further, small diameter fuse wires are fragile, and as a result, the manufacture of microfuses employing such wires requires special handling to reduce the incidence of fuse wire breakage.

In response to the breakage and handling problems associated with fuse wires used in microfuses, thick film fusing links have been proposed to replace the wire fusing link in the microfuse. The thick film element is deposited directly on the substrate typically by screen printing a conductive ink thereon. A mask is used to create a pattern having opposed welding pads for receiving fuse lead wires and a narrowed portion therebetween forming a fusing link. To change the ampere rating of the fuse, the minimum cross-sectional area of the narrowed portion (or weak spot) of the fuse is varied. For a given material for the fusing link, the narrower the cross-section, the lower the current required to cause the fuse to open. The physical properties of the thick film ink limit the minimum width of the weak spot to 2 to 8 times the typical thickness of 500 micro-inches. This minimum cross-sectional area of the thick film weak spot is too large to manufacture fuses having a rated capacity below approximately 1 amp for fuse link materials of silver. Fuse link materials with higher resistivity can be used, but they result in microfuses that have higher resistance, voltage drops and body temperatures and less interrupting ability.

A more effective way to reduce the amperage rating of the fuse, is to make the fusing link and weld pads of different thicknesses. This is best achieved by printing the fuse link with a thin film ink or by the deposition of a thin film using vapor deposition, sputtering, or chemical vapor deposition techniques. However, it has been found that where the thickness of the fusing link falls below approximately 100 micro-inches, the surface roughness of the substrate causes large variations of the thickness of the material forming the fusing link on the substrate, which leads to erratic fuse resistance and performance. Such erratic performance includes fuses having characteristics out of specification such as opening times, voltage drops and open fuses prior to use.

A typical ceramic substrate has an average surface roughness of approximately 10 to 40 micro-inches. A glass-coated ceramic substrate, however, has an average surface roughness of 0.06 micro-inches. Thus, a thin film metalization with a thickness of 6 micro-inches provides a continuous layer with less than 1% cross sectional area variation. The glass layer is 2,300 micro-inches thick.

If the entire ceramic chip is coated with glass, however, then a second problem is encountered. To achieve high speed automated assembly of the microfuse, the external leads are resistance welded to the metalized pads at the ends of the ceramic chip. The strength of this welded joint is not acceptable if there is a glass layer between the metalization and the ceramic substrate. The thermal shock of the resistance welding operation produces microcracks in the glass layer.

The inability to manufacture microfuses (with high speed automated equipment) having amperage ratings of less than 1 amp has denied the electronics industry a low cost fractional amperage microfuse.

The present invention overcomes these deficiencies of the prior art and permits the high speed automated manufacturing of microfuses in the 1/32 to 1 amperage range.

SUMMARY OF THE INVENTION

The present invention includes a patterned glass coating on an alumina ceramic substrate. By restricting the glass coating to stripes on the substrate and positioning the chip location properly, the glass coating is located only under the thin film fuse element and does not extend to the ends of the chip. Therefore the external leads are welded to metalizations that are applied directly onto the ceramic surface while the thin film metalization is applied to the glass-coated portion of the chip. This invention therefore provides a high strength welded joint for the external lead and a smooth surface for the thin film metalization.

The present invention can be manufactured at low cost with selected amperage ratings between 1/32 to 1 amp. Other objects and advantages of the invention will become apparent from the accompanying description of the preferred embodiment when read in conjunction with the accompanying drawings.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
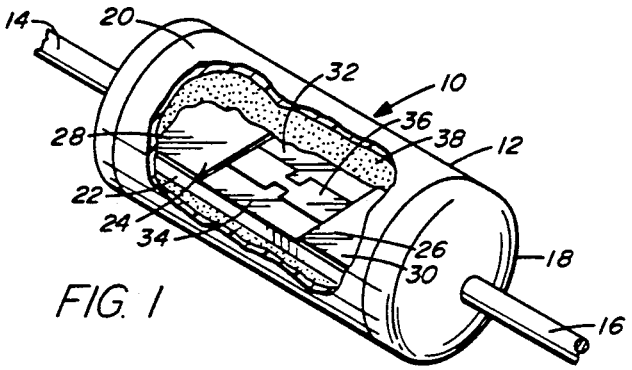
FIG. 1 is a perspective view, partially in cutaway, of the fuse of the present invention.

Referring initially to FIG. there is illustrated a generally cylindrical subminiature fuse 10, mounted within an insulative, rod-like plastic body 12 and having opposed leads 14, 16 projecting from opposite ends 18, 20 thereof for connecting fuse 10 to an electrical circuit. To conduct and selectively interrupt current across fuse 10, a substrate chip 22, with welding pads 24, 26 disposed on opposed ends 28, 30 thereof, is disposed within body 12 between leads 14, 16. Each lead 14, 16 is interconnected, preferably by resistance welding, to welding pads 24, 26, respectively. Welding pads 24, 26 terminate adjacent the medial portion 32 of chip 22 where a glass coating 34 is disposed on substrate chip 22. A thin film fusing link 36 is disposed on glass coating 34, and electrically interconnects welding pads 24, 26 across the medial portion 32 of substrate chip 22. A coating of arc quenching material 38 is disposed around fusing link 36 within body 12, to reduce the duration and ultimate energy which occurs during fuse interruptions.

Figure 2:
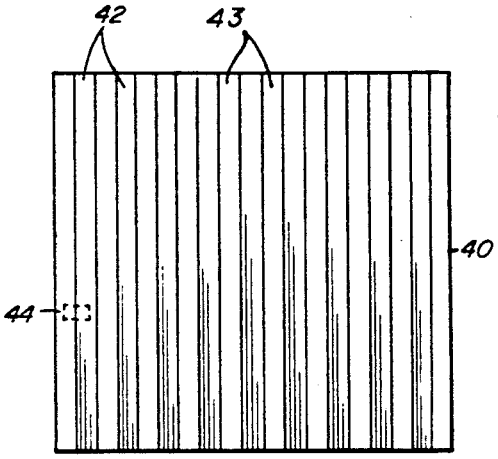
FIG. 2 is a top view of a glass-coated ceramic substrate used to produce the individual glass-coated chips for the fuse of FIG. 1.
Figure 3:
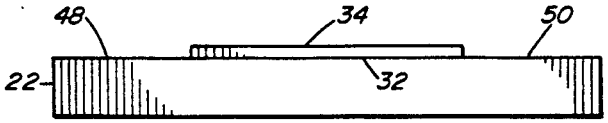
FIG. 3 is a side view of an individual glass-coated chip for the fuse of FIG. 1.
Figure 4:
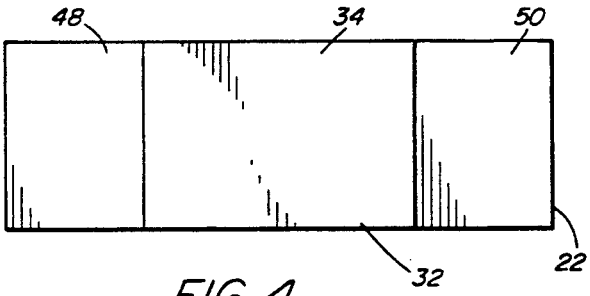
FIG. 4 is a top view of the chip of FIG. 3.

Referring now to FIGS. 2, 3 and 4, substrate chip 22 is a thin, ceramic planar member, preferably 0.025 inches thick, which is cut from a plate 40 having alternating glass stripes 42 and bare areas 43 thereon. Plate 40 is prepared by first screen printing a silica based liquid thereon in a stripe 42 pattern, and then firing plate 40 in an oven to cure the glass stripes 42 in place on plate 40. Each of stripes 42 is preferably about 0.0023 inches thick, having an average surface roughness of typically 0.06 micro-inches. As shown in FIG. 2, chip 22 is cut from plate 40 along phantom lines 44, such that each chip has a medial portion 32 covered with glass coating 34 and opposed bare sections 48, 50 on opposite sides of glass coating 34.

Figure 5:
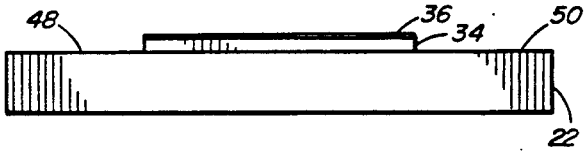
FIG. 5 is a side view of the chip of FIG. 4 further including a thin film fusing link disposed on the glass portion.
Figure 6:
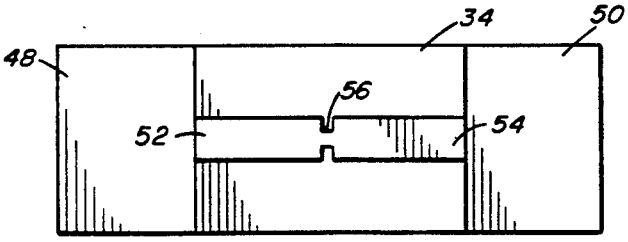
FIG. 6 is a top view of the chip of FIG. 5.

Referring now to FIGS. 5 and 6, the fusing link 36 is then placed on glass coating 34, preferably by screen printing the conductive ink directly to coating 34. Link 36 is preferably about 6 micro-inches thick. Link 36 spans coating 34 and includes opposed weld pad interfaces 52, 54 and a neck down area 56 therebetween. Neck down area 56 is a reduced width portion of fusing link 36 and may be varied in width. During manufacture of fuse 10, the width of neck down area 56 is sized for a particular amperage rating. The wider the width of neck down area 56, the greater the current carrying capacity of fuse 10.

Figure 7:
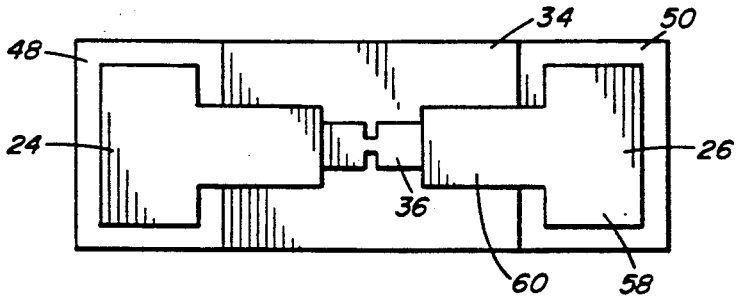
FIG. 7 is a top view of the chip of FIG. 6, further including welding pads disposed thereon.
Figure 8:
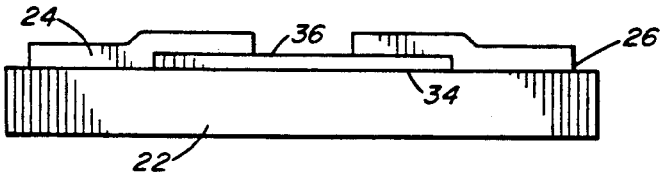
FIG. 8 is a side view of the chip of FIG. 7.
Figure 9:
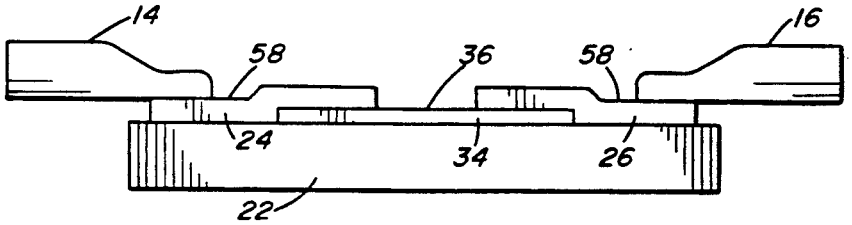
FIG. 9 is a side view of the chip of FIG. 8, further including leads disposed on the weld pads.

Referring now to FIGS. 7 and 8, weld pads 24, 26 are thick film screen printed on substrate chip 22, on glass coating 34 and portions of bare portions 48, 50 by using a conductive ink. Weld pads 24, 26 each include an enlarged portion 58 disposed on bare sections 48, 50, respectively, of substrate chip 22, and a cantilevered portion 60 extending onto glass coating 34 and weld pad interfaces 52, 54, respectively. Leads 14, 16 are then applied to enlarged portions 58 of weld pads 24, 26, respectively, preferably by resistance welding. The isolation of the welding to the enlarged portion 58 avoids cracking the glass coating 34 due to thermal stress during the welding operation.

Figure 10:
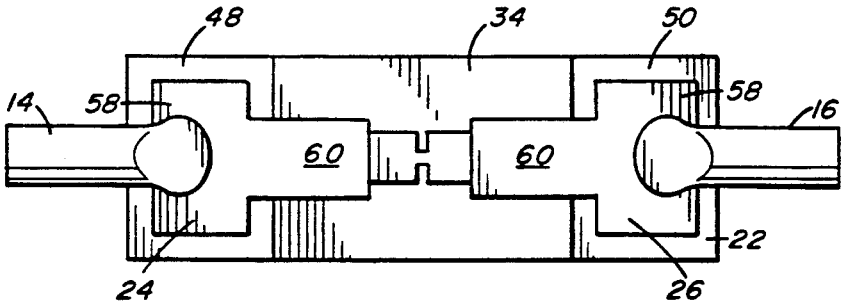
FIG. 10 is a top view of the chip of FIG. 9.
Figure 11:
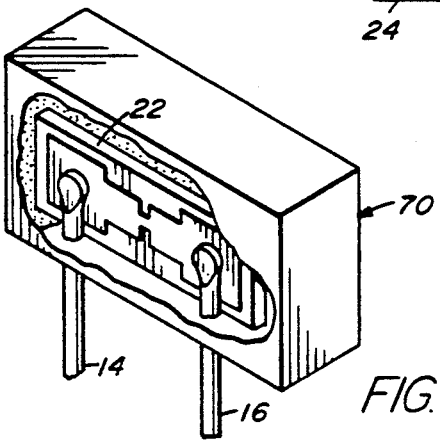
FIG. 11 is a perspective view, partially in cutaway, of an alternate construction of the fuse of the present invention.

Referring now to FIGS. 1, 10 and 11, once leads 14, 16 are attached to substrate chip 22, the coating of arc quenching material 38 is applied to substrate chip 22 over fusing link 36, and the entire assembly is then placed in a mold. Plastic body 12 is then injection molded thereabout, leaving the ends of leads 14, 16 projecting therefrom.

Figure 12:
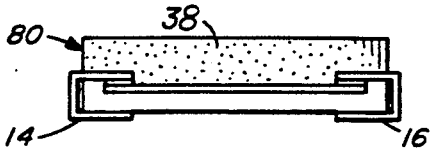
FIG. 12 is a cross-sectional view of a surface mount alternative embodiment of the present invention.

Referring now to FIGS. 11 and 12, alternate embodiments of the present invention are shown. In FIG. a fuse 70, employing substrate chip 22, includes leads 14, 16 which project parallel to each other from the same side of substrate chip 22 to form a clip type, as opposed to cylindrical, subminiature fuse. In FIG. 12, a fuse 80, employing substrate clip 22, includes leads 14, 16 which are flat and bend around the body of the fuse 80. The fuse package of FIG. 12 is described in U.S. Pat. No. 4,771,260.

By employing a smooth coating, such as glass, under the fusing link, thin film technology may be employed to create a subminiature fuse with ampere ratings below one amp. The glass coating provides one additional benefit. Since the thermal conductivity of glass is significantly lower than that of alumina, more of the heat generated in the fuse element is retained in the element and the time required to melt the element for a given overload current condition is reduced. It should be appreciated that this invention may be employed in large amperage fuses by enlarging the cross-section of the necked down portion 56, and where appropriate, that of the entire fuse link. Further, although a 6 micro-inch thin fuse link 36 has been described, other thicknesses may be employed. Also, the glass coating may be replaced by other appropriate materials with the requisite surface finish.

While a preferred embodiment of the invention has been shown and described, modifications thereof can be made by one skilled in the art without departing from the spirit of the invention.

I claim:

1. A fuse subassembly comprising:

an insulative substrate having a central portion disposed between opposed end portions;

an insulating coating disposed on said central portion only terminating in opposed edges;

a fuse element disposed on said insulating coating;

a metallized lead attachment pad disposed on each of said opposed end portions and extending over the edge of said insulating coating and contacting said fuse element;

an insulating coating with an average surface roughness limited to 25% of the thickness of the fuse element disposed on said insulating coating, and surface dislocations limited to 10% of the thickness of the fuse element.

2. The fuse subassembly of claim 1 wherein said insulating coating is glass.

3. The fuse subassembly of claim 1 wherein said fuse element is less than 100 micro-inches thick.

4. The fuse subassembly of claim 1 wherein said insulative substrative is ceramic.

5. A fuse comprising the fuse subassembly of claim 1 and;

leads attached to and projecting outward from said lead attachment pads;

arc quenching coating substantially covering the fuse element;

molded plastic enclosure surrounding said subassembly and coating with leads projecting therefrom.

6. A fuse comprising and fuse subassembly claim 1 and;

leads attached to and projecting outward from said lead attachment pads;

molded plastic enclosure surrounding said subassembly with leads projecting therefrom.

7. A fuse comprising;

a tube of insulating material;

an insulative substrate disposed within said tube and having a central portion disposed between opposed end portions;

an insulating coating disposed on said central portion only and having opposed edges;

a fuse element having a thickness of less than 100 micro-inches disposed on said insulating coating;

a metallized lead attachment pad disposed on each of said opposed end portions and extending over the edge of said insulating coating and contacting said fuse element; and end caps that mate with the tube and make electrical contact to said lead attachment pads.

8. The fuse of claim 7, wherein said insulating coating is glass.

9. The fuse of claim 7, wherein said insulating coating has a surface roughness which is less than twenty five percent of the thickness of said fuse element.

10. The fuse of claim 7, wherein the surface of said insulating coating in contact with said fuse element has surface dislocations which are lower in height than then percent of the thickness of said fuse element.

11. A fuse subassembly comprising:

an insulative substrate having a central portion disposed between opposed end an insulating coating disposed on said insulative substrate;

a thin film fuse element disposed on said insulating coating;

at least one metallized lead attachment pad disposed on said substrate and in contact with said fuse element, a portion thereof in direct contact with said substrate;

wherein said insulating coating has an average surface roughness equal to or less than twenty five percent of the thickness of said fuse element.

12. A fuse subassembly comprising:

an insulative substrate having a central portion disposed between opposed end portions;

an insulating coating disposed on said insulative substrate;

a thin film fuse element disposed on said insulating coating;

at least one metallized lead attachment pad disposed on said substrate and in contact with said fuse element, a portion thereof in direct contact with said substrate;

wherein the surface dislocations on said insulating coating are limited to ten percent of the thickness of said fuse element.

13. The fuse subassembly of claim 11, wherein said substrate is ceramic.

14. A fuse subassembly comprising:

an insulative substrate having a central portion disposed between opposed end portions;

an insulating coating disposed on said insulative substrate;

a fuse element having a thickness of less than one hundred micro inches disposed on said insulating coating;

at least one metallized lead attachment pad disposed on said substrate and in contact with said fuse element, a portion thereof in direct contact with said substrate;

wherein said insulating coating has an average surface roughness equal to or less than twenty five percent of the thickness of said fuse element.

15. A fuse subassembly comprising:

an insulative substrate having a central portion disposed between opposed end portions;

an insulating coating disposed on said insulative substrate;

a fuse element having a thickness of less than one hundred micro inches disposed on said insulating coating;

at least one metallized lead attachment pad disposed on said substrate and in contact with said fuse element, a portion thereof in direct contact with said substrate;

wherein the surface dislocations on said insulating coating are limited to ten percent of the thickness of said fuse element.

16. A fuse subassembly comprising:

an insulative substrate having a central portion disposed between opposed end portions;

an insulating coating disposed on said insulative substrate;

a fuse element having a thickness of less than one hundred micro inches disposed on said insulating coating;

at least one metallized lead attachment pad disposed on said substrate and in contact with said fuse element, a portion thereof in direct contact with said substrate;

wherein said substrate is ceramic.

* * * * *